US011402168B2

(12) United States Patent
Laney et al.

(10) Patent No.: US 11,402,168 B2
(45) Date of Patent: Aug. 2, 2022

(54) FIREARM HAVING A DETACHABLE STOCK

(71) Applicant: Smith & Wesson Inc., Springfield, MA (US)

(72) Inventors: Mark Laney, Lee, NH (US); Karl Ricker, Brookfield, NH (US)

(73) Assignee: Smith & Wesson Inc., Springfield, MA (US)

( * ) Notice: Subject to any disclaimer, the term of this patent is extended or adjusted under 35 U.S.C. 154(b) by 0 days.

(21) Appl. No.: 17/239,967

(22) Filed: Apr. 26, 2021

(65) Prior Publication Data

US 2022/0065569 A1 Mar. 3, 2022

Related U.S. Application Data

(60) Provisional application No. 63/069,744, filed on Aug. 25, 2020.

(51) Int. Cl.
*F41C 23/14* (2006.01)
*F41A 11/04* (2006.01)

(52) U.S. Cl.
CPC ..... *F41A 11/04* (2013.01)

(58) Field of Classification Search
CPC ..... F41C 23/04; F41C 23/14; F41C 27/06; F41A 3/84; F41A 11/02; F41A 3/66; F41A 11/04; F41A 19/10; F41A 3/26; F41A 35/06; F41B 7/08
USPC ..... 42/73, 1.06, 71.01, 72, 74, 71.02, 42/75.01–75.1; 89/191.01, 193, 198
See application file for complete search history.

(56) References Cited

U.S. PATENT DOCUMENTS

| | | | | |
|---|---|---|---|---|
| 3,348,328 | A | 10/1967 | Roy | |
| 4,922,941 | A | 5/1990 | Daniels | |
| 7,717,122 | B2 | 5/2010 | Jacobs et al. | |
| 7,735,500 | B2 | 6/2010 | Jacobs et al. | |
| 8,127,483 | B2 | 3/2012 | Kincel | |
| 8,327,569 | B2 | 12/2012 | Kincel | |
| 8,474,169 | B2 | 7/2013 | Cottle et al. | |
| 9,410,763 | B2 * | 8/2016 | Colt | F41C 23/14 |
| 9,612,083 | B2 | 4/2017 | Cottle et al. | |
| 10,161,711 | B2 | 12/2018 | Moretti | |
| 11,280,580 | B2 * | 3/2022 | Liptak | F41C 23/12 |
| 2012/0073177 | A1 * | 3/2012 | Laney | F41C 23/16 42/16 |
| 2012/0137556 | A1 * | 6/2012 | Laney | F41C 23/16 42/6 |

* cited by examiner

*Primary Examiner* — Michael D David
(74) *Attorney, Agent, or Firm* — John A. Chionchio, Esq.; Ballard Spahr LLP

(57) ABSTRACT

A firearm has a receiver with a receptacle. A stock has a projection which is received within the receptacle to mount the stock on the receiver. A spring biased detent holds the stock in engagement with the receptacle. Manual manipulation of the detent allows the stock to be removed from the firearm's receiver.

8 Claims, 3 Drawing Sheets

FIREARM HAVING A DETACHABLE STOCK

CROSS REFERENCE TO RELATED APPLICATIONS

This application is based upon and claims benefit of priority to U.S. Provisional application No. 63/069,744, filed Aug. 25, 2020, which application is hereby incorporated by reference herein.

FIELD OF THE INVENTION

This invention relates to firearms, and detachable stocks therefor.

BACKGROUND

A detachable stock is an advantageous feature for firearms, in particular the modern sporting rifle. A detachable stock permits easy replacement of the stock for repair or to provide a customized fit to a shooter. A detachable stock also permits compact transport of firearms in the field, to a gun range, a gunsmith or in commerce.

In view of the various advantages of a detachable stock there is clearly an opportunity to provide a mechanism which permits ready mounting and dismounting of the stock from the receiver of a modern sporting rifle while simultaneously securely fastening the stock to the rifle for precision shooting.

SUMMARY

The invention concerns a firearm such as a rifle. In an example embodiment according to the invention the firearm comprises a receiver having a receptacle at one end thereof. The receptacle has an inner surface defining a bore arranged coaxially with an axis. The receptacle defines a first opening arranged coaxially with the axis and a second opening arranged transversely to the axis. A stock comprises a butt positioned at a first end thereof and a projection extending from a second end opposite to the first end. The projection is insertable into and removable from the receptacle. A plunger is mounted on the projection. The plunger is oriented transversely to the axis when the projection engages the receptacle. A spring acts between the plunger and the projection and biases the plunger into engagement with the second opening when the plunger is aligned therewith when the projection engages the receptacle. Engagement between the plunger and the second opening retains the stock to the receiver.

Further by way of example, a ramp surface may be positioned on the inner surface of the receptacle. The ramp surface is oriented at an angle with respect to the axis. The ramp surface is contiguous with the first opening. The ramp surface may be angularly offset from the second opening about the axis. In a particular example embodiment the ramp surface is angularly offset from the second opening at an offset angle of 90° about the axis. By way of example the ramp surface may comprise a conical surface surrounding the first opening. Specifically by way of example the conical surface may subtend an angle of less than 180° at the first opening.

Additionally by way of example an O-ring may be positioned on the projection and seated within a circumferential groove extending around the projection.

DETAILED DESCRIPTION

Figure 1:
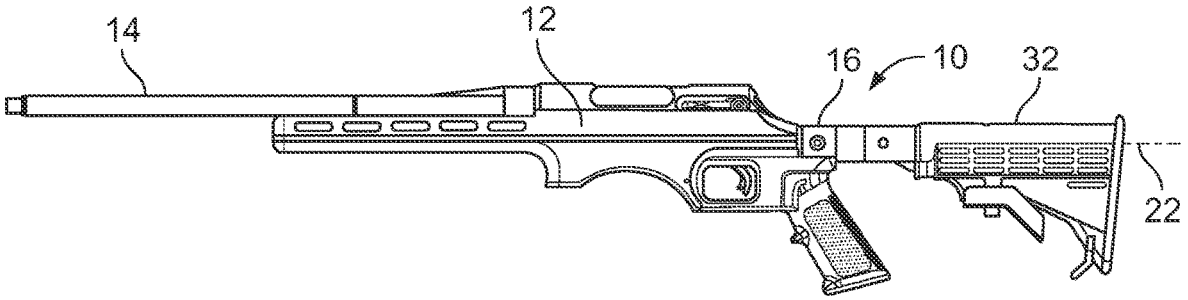
FIG. 1 is a side view of an example firearm according to the invention.

FIG. 1 shows a firearm 10, in this example a rifle, according to the invention. Firearm 10 comprises a receiver 12 on which a barrel 14 is mounted. Receiver 10 also contains the firearm's action (not shown) as well as its fire control group (not shown) as is well understood in this context. Receiver 12 has a receptacle 16 positioned at one end thereof (see also FIGS. 4 and 4A). As shown in FIG. 4A, receptacle 16 has an inner surface 18 defining a bore 20 arranged coaxially with an axis 22. Receptacle 16 defines a first opening 24 arranged coaxially with the axis 22 and a second opening 26 arranged transversely to the axis. As further shown in FIG. 4A, a ramp surface 28 is positioned on the inner surface 18. Ramp surface 28 is oriented at an angle 30 with respect to the axis 22. Ramp surface 28 is contiguous with the first opening 24 and may comprise a conical surface which subtends an angle of less than 180° at the first opening. In another example embodiment the ramp surface may comprise a conical surface surrounding the first opening 24.

Figure 2:
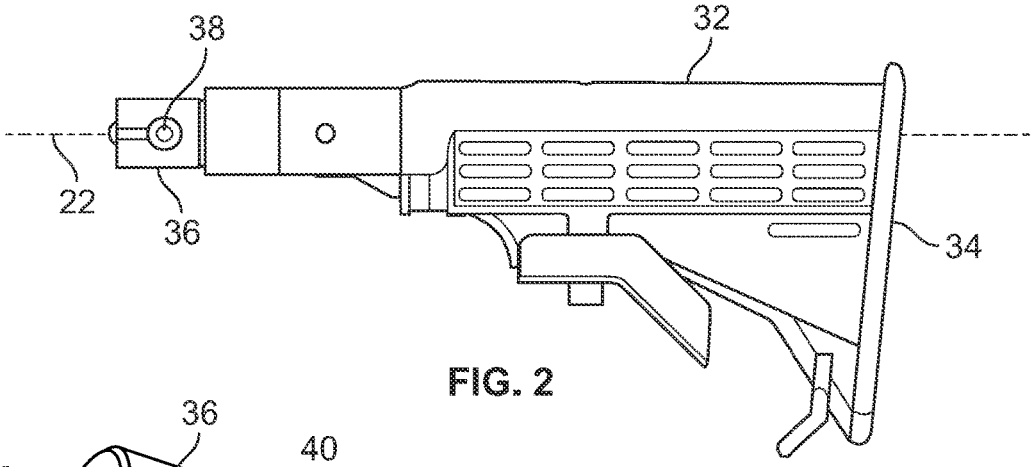
FIG. 2 is a side view of an example detachable stock according to the invention.
Figure 3:
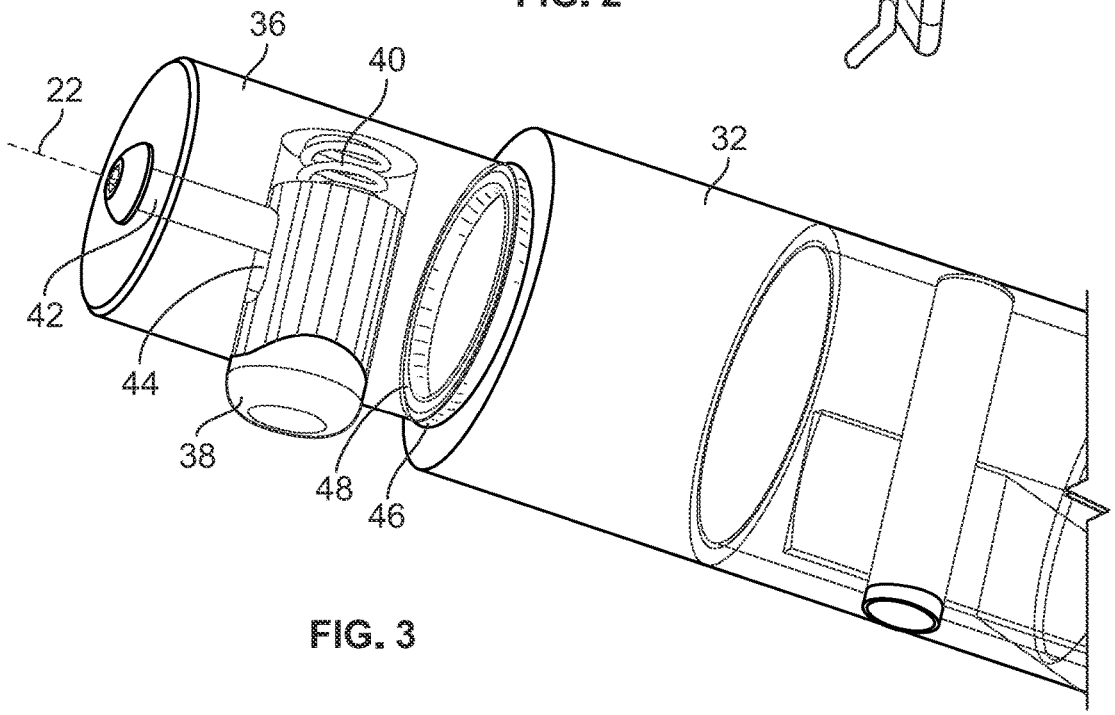
FIG. 3 is an isometric transparent view of a portion of the detachable stock shown in FIG. 2.

As shown in FIG. 1, firearm 10 also comprises a stock 32. As shown in FIG. 2, stock 32 comprises a butt 34 positioned at a first end thereof and a projection 36 extending from a second end opposite to the first end. Projection 36 is insertable into and removable from the receptacle 16. As shown in FIGS. 2 and 3, a plunger 38 is mounted on the projection 36. The plunger 38 is oriented transversely to the axis 22 when the projection 36 engages the receptacle 16. A spring 40 acts between the plunger 38 and the projection 36 and biases the plunger into engagement with the second opening 26 when the plunger is aligned therewith when the projection engages the receptacle 16. Engagement between the plunger 38 and the second opening 26 retains the stock 32 to the receiver 12. In this example embodiment plunger 38 comprises a cylindrical body, but other plunger shapes, such as a spherical plunger are also feasible.

Figure 4:
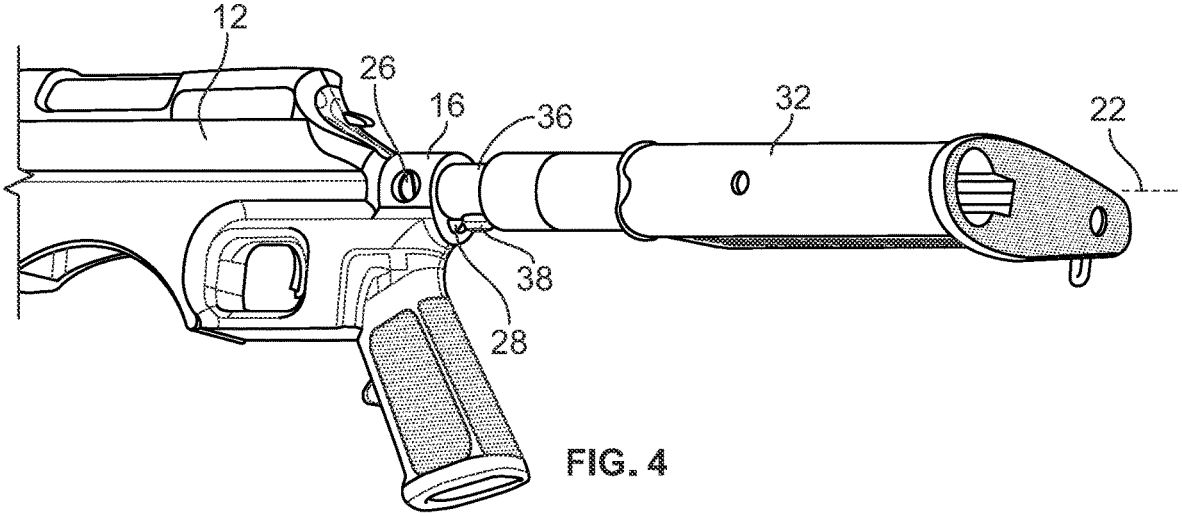
FIGS. 4 and 4A are isometric views illustrating assembly of the firearm shown in FIG. 1, FIG. 4A being shown on an enlarged scale.
Figure 5:
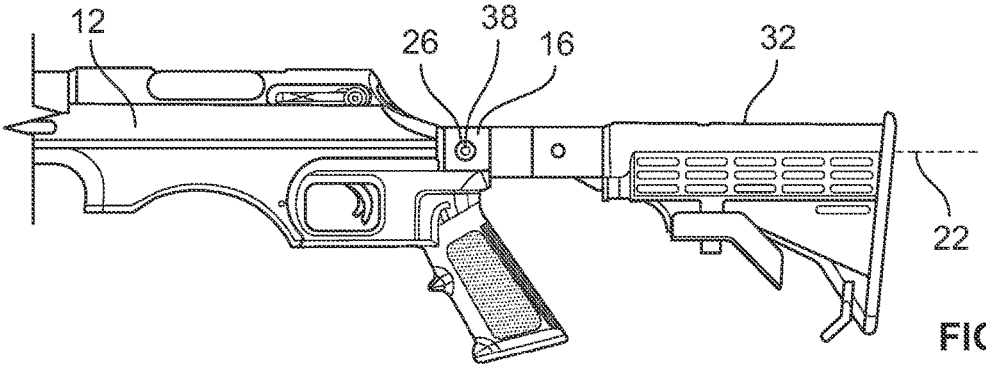
FIGS. 5 and 6 are side views of a portion of the firearm shown in FIG. 1 illustrating disassembly of the firearm.
Figure 6:
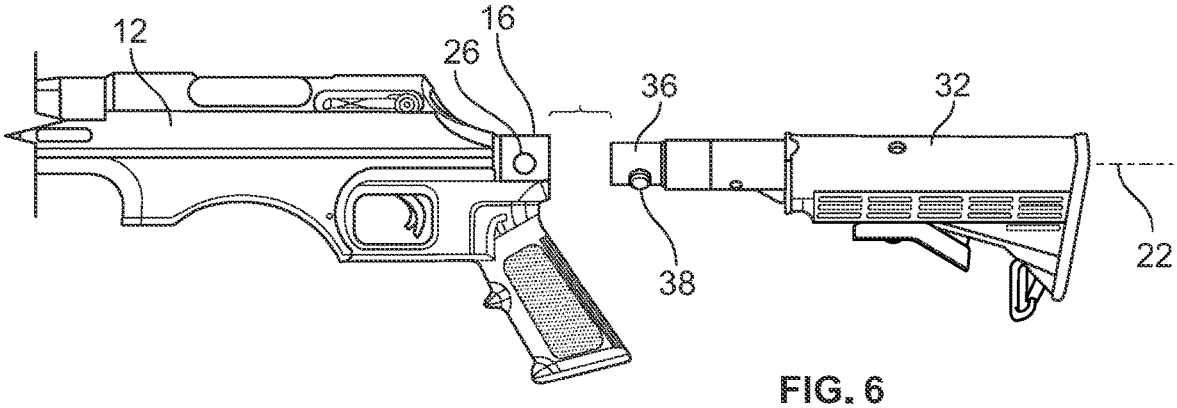
Figure 4A:
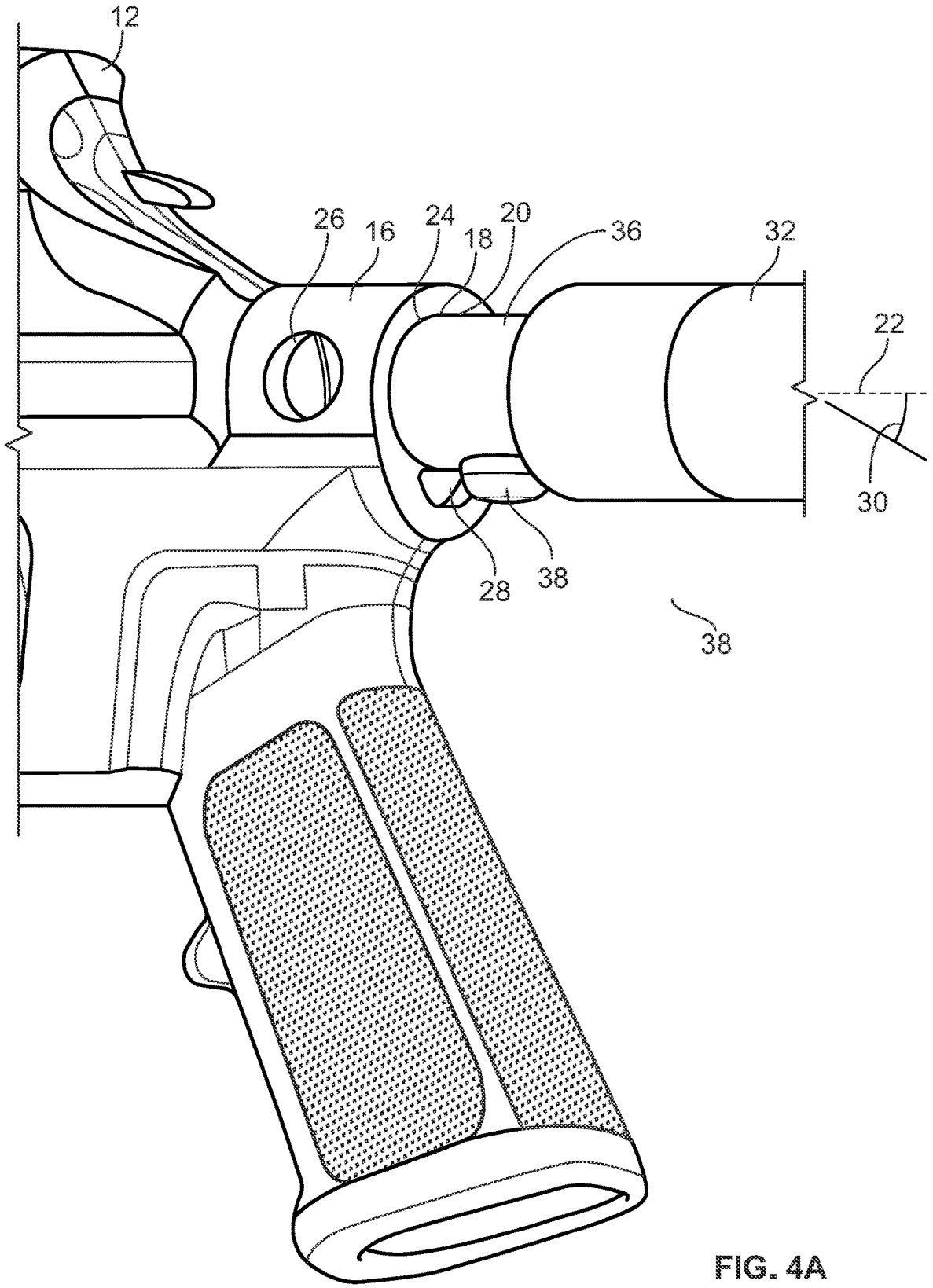

Operation of the detachable stock 32 is illustrated in FIGS. 4-6. To mount the stock 32 to the firearm 10 as shown in FIG. 4, the projection 36 is aligned with axis 22. The stock 32 is further oriented so that the plunger 38 aligns with the ramp surface 28 at the first opening of the receptacle 16. In this example embodiment this alignment necessitates orienting the stock 32 at an angular position about axis 22 other than its final, functional angular position (see FIGS. 1 and 5) because the ramp surface 28 is angularly offset from the second opening 26 about the axis 22. In this example the ramp surface 28 is angularly offset from the second opening 26 at an offset angle of 90° about the axis 22.

Stock 32 is then manipulated to insert the projection 36 into the receptacle 16. Plunger 38 engages the ramp surface 28 and moves toward the projection, compressing its biasing spring 40, thereby permitting the projection 36 to be received within the receptacle 16 and align with the second opening 26. As shown in FIG. 5, the stock 32 is then rotated about axis 22 to bring the plunger 38 into alignment with the second opening 26. Upon this alignment the stock 32 is brought to its functional position and the plunger is biased outwardly from the projection 36 and extends through the second opening 26, thereby providing mechanical engagement between the plunger 38 and the receptacle 16 which retains the stock 32 to the receiver 12. As shown in FIG. 3, the length of travel of the plunger 38 within the projection 36 is limited by a retention bolt 42 which is threadedly mounted within the projection 36 and engages a longitudinal guide recess 44 in the plunger 38. Detachment of the stock 32 proceeds as shown in FIGS. 5 and 6, wherein the plunger 38 is depressed to disengage it from the second opening 26. This allows the stock 32 to be withdrawn from the receptacle 16 as shown in FIG. 6. It may be advantageous to rotate the stock 32 about axis 22 to align the plunger 38 with the ramp surface 28 after the plunger 38 is disengaged from the second opening 26 but before the projection 36 is withdrawn from the receptacle 16. A tight fit of the projection 36 within the receptacle 16 may be enhanced by the use of an O-ring 46 surrounding the projection. O-ring 46 is advantageously made of an elastomeric material such as a rubber compound and has a cross sectional diameter and an outer diameter sized in relation to the projection 36 and the receptacle 16 such that the O-ring outer diameter is slightly larger than the inner diameter of the receptacle. Thus the O-ring 46 will be compressed when the projection is received within the receptacle and provide a tight fit to releasably retain the stock 32 to the receiver 12. O-ring 46 may be seated within a circumferential groove 48 in the projection 36 so that the O-ring maintains its position when the projection 36 is withdrawn from the receptacle 16 to remove the stock 32 from the receiver 12.

What is claimed is:

1. A firearm, said firearm comprising:

a receiver having a receptacle at one end thereof, said receptacle having an inner surface defining a bore arranged coaxially with an axis, said receptacle defining a first opening arranged coaxially with said axis and a second opening arranged transversely to said axis;

a stock comprising a butt positioned at a first end thereof and a projection extending from a second end opposite to said first end, said projection being insertable into and removable from said receptacle;

a plunger mounted on said projection, said plunger being oriented transversely to said axis when said projection engages said receptacle;

a spring acting between said plunger and said projection and biasing said plunger into engagement with said second opening when said plunger is aligned therewith when said projection engages said receptacle, wherein engagement between said plunger and said second opening retains said stock to said receiver.

2. The firearm according to claim 1, further comprising a ramp surface positioned on said inner surface of said receptacle, said ramp surface being oriented at an angle with respect to said axis, said ramp surface being contiguous with said first opening.

3. The firearm according to claim 2, wherein said ramp surface is angularly offset from said second opening about said axis.

4. The firearm according to claim 2, wherein said ramp surface is angularly offset from said second opening at an offset angle of 90° about said axis.

5. The firearm according to claim 2, wherein said ramp surface comprises a conical surface surrounding said first opening.

6. The firearm according to claim 5, wherein said conical surface subtends an angle of less than 180° at said first opening.

7. The firearm according to claim 1, further comprising an O-ring positioned on said projection.

8. The firearm according to claim 7, wherein said O-ring is seated within a circumferential groove extending around said projection.

* * * * *